US006095865A

United States Patent [19]

Wu

[11] Patent Number: 6,095,865

[45] Date of Patent: Aug. 1, 2000

[54] MODULAR JACK

[75] Inventor: Kun-Tsan Wu, Tu-Chen, Taiwan

[73] Assignee: Hon Hai Precision Ind. Co., Ltd., Taipei Hsien, Taiwan

[21] Appl. No.: 09/356,484

[22] Filed: Jul. 19, 1999

[30] Foreign Application Priority Data

Oct. 23, 1998 [TW] Taiwan ..... 87217622

[51] Int. Cl.[7] ..... H01R 13/648

[52] U.S. Cl. ..... 439/607; 439/79

[58] Field of Search ..... 439/607, 609, 439/79, 676

[56] References Cited

U.S. PATENT DOCUMENTS

| | | | |
|---|---|---|---|
| 5,236,375 | 8/1993 | Kachlic | 439/79 |
| 5,316,488 | 5/1994 | Gardner et al. | 439/79 |
| 5,316,489 | 5/1994 | Kachlic et al. | 439/79 |
| 5,637,015 | 6/1997 | Tan et al. | 439/609 |
| 5,660,558 | 8/1997 | Osanai et al. | 439/607 |
| 5,718,605 | 2/1998 | Morikawa et al. | 439/607 |
| 5,934,939 | 8/1999 | Thenaisie et al. | 439/607 |

*Primary Examiner*—Gary F. Paumen
*Attorney, Agent, or Firm*—Wei Te Chung

[57] ABSTRACT

A modular jack comprises an insulative housing, a terminal assembly including an insulative terminal holder and a number of terminals retained in the holder and a shielding assembly including a first shield and a second shield. The housing is substantially rectangular and defines an inner space for accommodating the terminals and a mating plug therein. The first shield and the second shield are assembled together to enclose the housing. A pair of legs outwardly and downwardly extends from lower side edges of the first shield. A circuit board defines a rectangular cutout for snugly accommodating the modular jack. The legs are adapted to secure the modular jack to the circuit board. A pair of support arms rearwardly extends from the rear wall of the housing for resting on a rear edge of the cutout of the circuit board thereby supporting the modular jack thereon.

18 Claims, 4 Drawing Sheets

MODULAR JACK

BACKGROUND OF THE INVENTION

The present invention relates to a modular jack, and particularly to a modular jack having a reduced height above a circuit board to which the modular jack is mounted.

A modular jack, as disclosed in U.S. Pat. Nos. 5,788,538 and 5,772,466, is commonly used in telecommunication systems and data networking equipment. The modular jack provides a means of communication between electronic equipment. When mounted within a note book computer or other compact electronic device, the modular jack is required to have a limited height above a circuit board to which the modular jack is mounted. Thus, the modular jack is manufactured to have a minimum thickness. However, a modular jack of a reduced thickness is not strong enough to accommodate conductive terminals in a housing thereof. A modular jack frequently engages and disengages with electrical plugs thereby further increasing the stress exerted on the housing of the modular jack. Hence, a durable modular jack having a reduced height above the circuit board is of considerable value.

SUMMARY OF THE INVENTION

Accordingly, an object of the present invention is to provide a durable modular jack having a limited height above a circuit board to which the modular jack is mounted.

To fulfill the above-mentioned object, a modular jack in accordance with the present invention comprises an insulative housing, a terminal assembly, a first shield and a second shield. The housing is substantially rectangular and defines an inner space therebetween for accommodating the terminal assembly. The terminal assembly includes an insulative holder and a plurality of terminals retained in the holder. The first shield and second shield are assembled together to enclose the housing. A pair of legs outwardly and downwardly extends from lower side edges of the first shield.

A circuit board defines a rectangular cutout for snugly accommodating the modular jack therein. The legs are inserted into corresponding holes in the circuit board thereby securing the modular jack within the cutout of the circuit board. Thus, a lower portion of the modular jack is located below the circuit board thereby providing the modular jack with a limited height above the circuit board. A pair of support arms rearwardly extends from side walls of the housing for resting on a rear edge of the cutout of the circuit board thereby supporting the modular jack thereon.

DETAILED DESCRIPTION OF THE INVENTION

Figure 1:
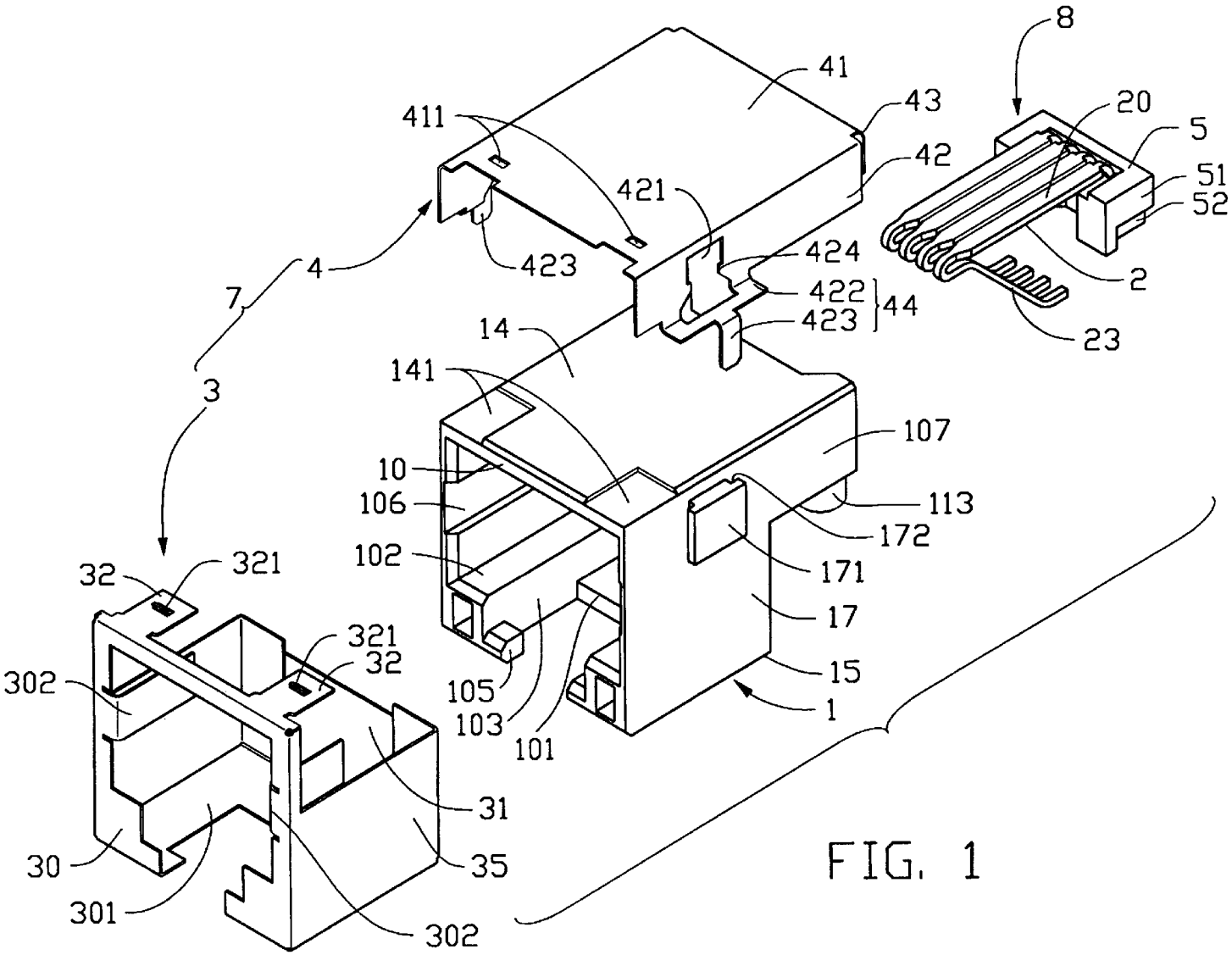
FIG. 1 is an exploded view of the modular jack of the present invention.
Figure 2:
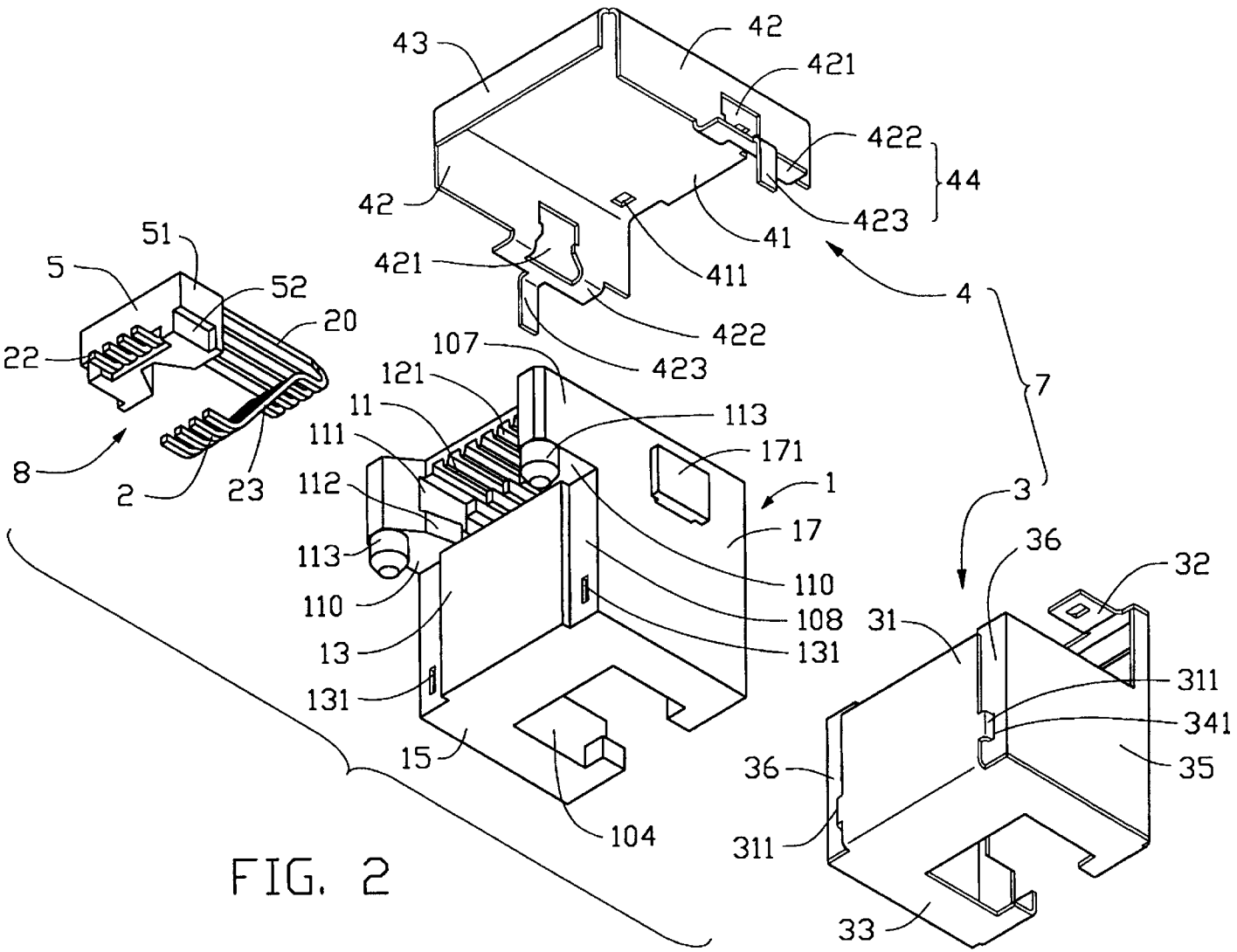
FIG. 2 is similar to FIG. 1 but taken from a different angle.

Referring to FIGS. 1 and 2, the modular jack in accordance with the present invention comprises an insulative housing 1, a terminal assembly 8 including an insulative holder 5 and a row of terminals 2 mounted in the holder 5, a shielding assembly 7 including a first shield 4 and a second shield 3.

The housing 1 is substantially rectangular and has a front wall 10, a rear wall 13, a top wall 14, a bottom wall 15 and a pair of side walls 17 defining an inner space 101 therein. A front opening 103 is formed in the front wall 10 and a bottom opening 104 is formed in the bottom wall 15. The front opening 103 and the bottom opening 104 are in communication with the inner space 101. A mating plug (not shown) extends through the front opening 103 into the inner space 101. A pair of shoulders 102 inwardly projects from inner surfaces of the side walls 17 proximate the bottom wall 15. A pair of tangs 105 inwardly extends from ends of the shoulders 102. The shoulders 102, the tangs 105 and the bottom opening 104 are adapted to support the inserted mating plug. A groove 106 is formed in the inner surface of each side wall 17. A T-shaped support portion 171 outwardly projects from each side wall 17 for supporting the insulative housing on the circuit board and for engaging the first shield 4. A pair of retention grooves 172 is defined at opposite edges of the support portion 171. A pair of recesses 141 is defined in the top wall 14 proximate front and side edges thereof. A pair of elongate recesses 108 is defined in the rear wall 13 proximate side edges thereof and a slit 131 is further defined in each recess 108.

The top wall 14 rearwardly extends beyond the rear wall 13. A plurality of terminal receiving grooves 121 is defined in an inner surface of the top wall 14 from a rear edge thereof to a portion proximate the front edge thereof. A rear opening 11 is defined in the rear wall 13 proximate the top wall 14. A pair of support arms 107 rearwardly extends from the side walls 17 to further define the rear opening 11. A bottom surface 110 of the support arms 107 is spaced apart from a bottom surface of the housing 1. A positioning post 113 downwardly projects from a bottom surface of each support arm 107. Each support arm 107 forms a securing recess 111 and a projection 112 proximate the recess 111 for engaging with the terminal holder 5.

Figure 4:
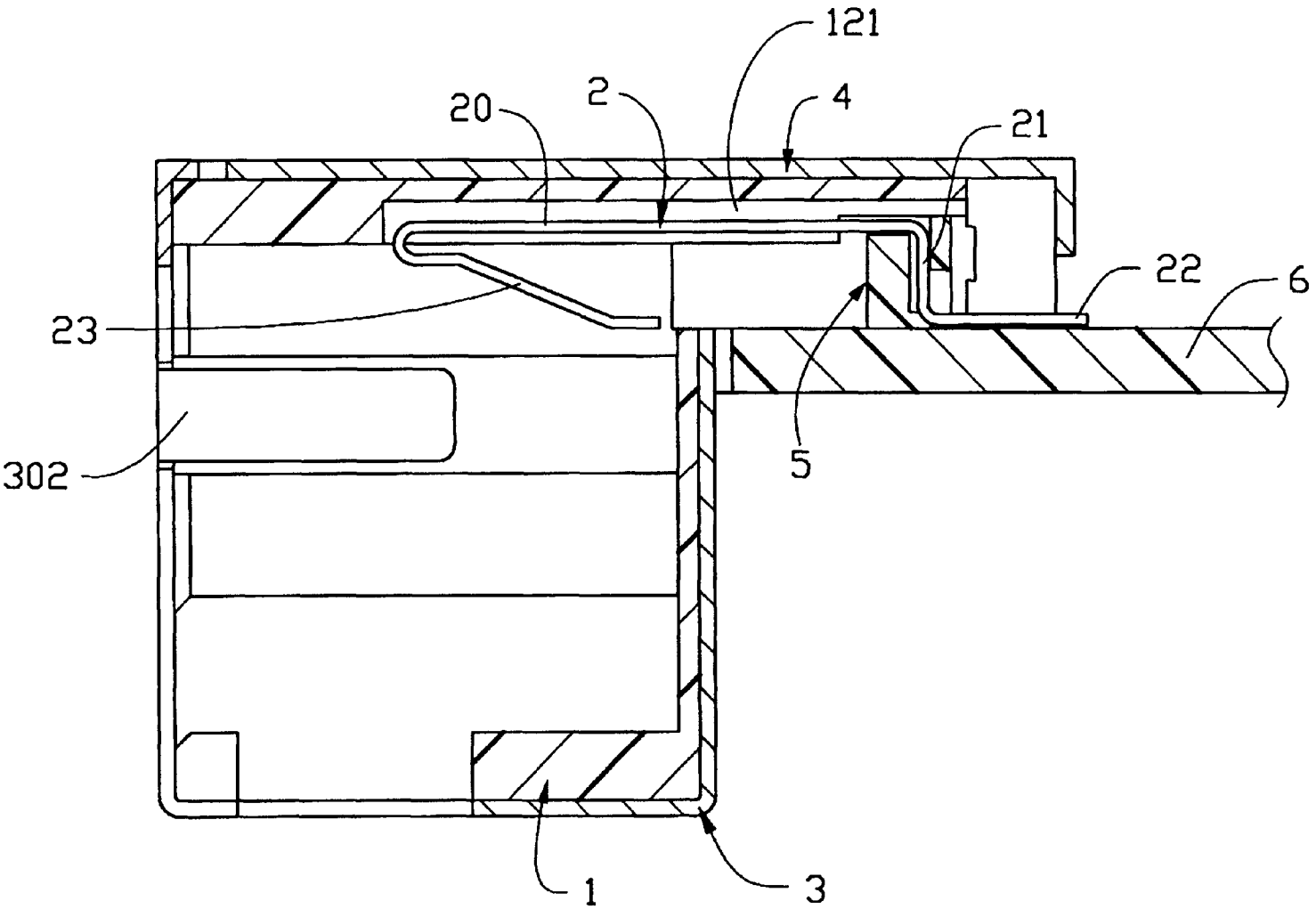
FIG. 4 is a cross sectional view of FIG. 3 taken along line 4—4.

Also referring to FIG. 4, the terminals 2 each include a center portion 20, a contact portion 23 reversely bent from the center portion 20, a mounting portion 21 perpendicular to the center portion 20 and mounted in the terminal holder 5, and a tail portion 22 perpendicular to the mounting portion 21 and extending rearwardly beyond the terminal holder 5. The terminals 2 are insert molded to the holder 5. The terminal assembly 8 is inserted into the inner space 101 of the housing 1 through the rear opening 11. The terminals 2 are received in the grooves 121 of the top wall 14. The terminal holder 5 defines a pair of mounting recesses 52 in opposite sides 51 thereof. A portion of each side 51 of the terminal holder 5 engages with the recess 111 of the corresponding support arm 107 of the housing 1 and the projections 112 of the support arms 107 engage with the mounting recesses 52 thereby securing the terminal holder 5 together with the terminals 2 to the housing 1.

The first shield 4 is unitarily stamped and includes a planar portion 41, a pair of side shielding walls 42 downwardly bent from opposite side edges of the planar portion 41, and a rear shielding wall 43 downwardly bent from a rear edge of the planar portion 41. A pair of holes 411 is defined in the planar portion 41 proximate a front edge thereof for engaging with the second shield 3. A leg 44 outwardly extending from a lower edge of each side shielding wall 42, includes a wide horizontal portion 422 and a narrow perpendicular portion 423. A mounting opening 421 is defined in each side shielding wall 42 and partially extends into the horizontal portion 422 of the corresponding leg 44 for engaging with the housing 1. A pair of retention tabs 424 is formed along opposite edges of the mounting opening.

The second shield 3 is unitarily stamped and includes a bottom cover 33, a front cover 30 upwardly extending from a front edge of the bottom cover 33, a pair of side covers 35 rearwardly extending from opposite edges of the front cover 30 and a rear cover 31 upwardly extending from a rear edge of the bottom cover 33. The rear cover 31 forms a pair of hooks 311 adapted to engage with apertures 341 defined in flanges 36 inwardly bent from the side covers 35. The flanges 36 are retained in the recesses 108 of the housing 1. The hooks 311 of the second shield 3 further engage in the slits 131 of the recesses 108 of the housing 1. A pair of mounting tabs 32 rearwardly extends from an upper edge of the front cover 30. A lance 321 is outwardly stamped from each mounting tab 32 for engaging in the corresponding hole 411 of the planar portion 41 of the first shield 4. The mounting tabs 32 of the second shield 3 are received in the recesses 141 of the top cover 14 of the housing 1. A through opening 301 is defined in the front cover 30 of the second shield 3 corresponding to the opening 103 of housing 1. A pair of securing strips 302 rearwardly extends from opposite edges of the opening 301 of the second shield 3 and is received in the grooves 106 of the side walls 17 of the housing 1 for grounding the inserted plug.

Figure 3:
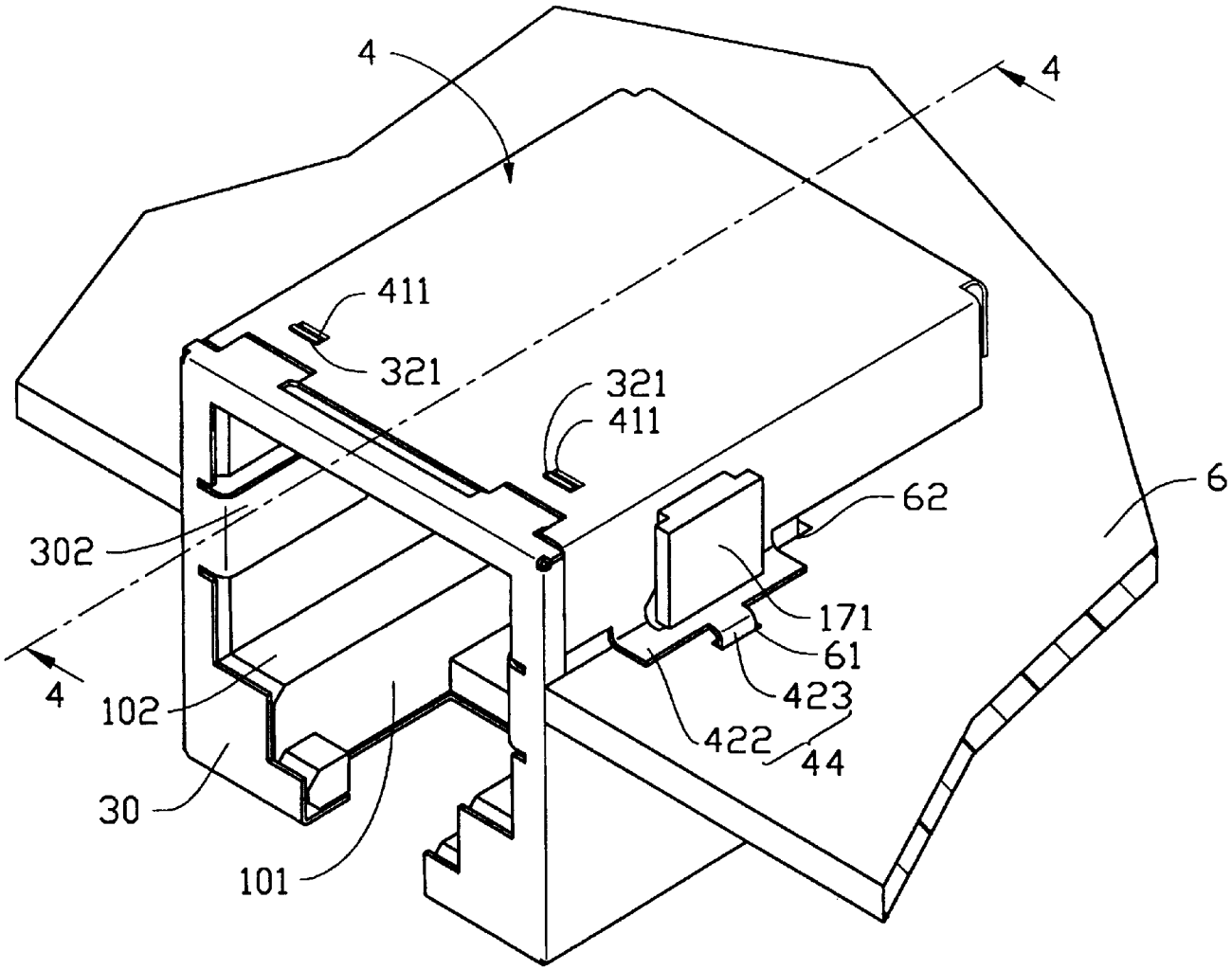
FIG. 3 is an assembled view of FIG. 1, wherein the modular jack is mounted in a cutout of a circuit board.

In assembly, the first shield 4 is assembled to the second shield 3 to form a chamber for accommodating the housing 1. The T-shaped support portions 171 of the side walls 17 of the housing 1 engage with the mounting openings 421 of the first shield 4 with the opposite edges retained in the retention grooves 172 and the retention tabs 424 engaging a bottom of the support portion 171 thereby securing the first and second shields 4, 3 to the housing 1. Referring to FIG. 3, a circuit board 6 to which the modular jack is mounted forms a cutout 62 for snugly receiving the modular jack therein. The lower surfaces 110 of the support arms 107 of the housing 1 rest on a rear edge of the cutout 62 and the positioning posts 113 extend into corresponding holes (not shown) defined in the circuit board 6 for retaining the modular jack thereon. The legs 44 of the first shield 4 are inserted into corresponding holes 61 defined in the circuit board 6 for further securing the modular jack to the circuit board 6 and are soldered to a corresponding grounding connection on the circuit board 6 thereby grounding the first and second shield 4, 3. The leg 44 may be replaced by a solder pad adapted to be soldered to the circuit board 6 using Surface Mounting Technology. The tail portions 22 of the terminals 2 are then soldered to the circuit board 6.

Thus, the lower portion of the modular jack is located below the circuit board 6 thereby providing the modular jack with a reduced height above the circuit board 6. Since the reduced height of the modular jack above the circuit board 6 does not result from a reduced thickness of the housing 1, the housing 1 is sufficiently durable for properly accommodating terminals 2 therein.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector mounted in a cutout defined in a circuit board, comprising:

an insulative housing having a top wall, a bottom wall, a rear wall, a front wall and a pair of side walls defining an inner space therebetween for receiving a mating plug, a front opening defined in the front wall for entrance of the mating plug, and at least one support arm rearwardly extending from an upper portion of the rear wall, each support arm having a bottom surface for resting on an edge of the cutout of the circuit board;

a terminal assembly including an insulative holder accommodated in the interior space of the housing and a plurality of terminals retained in the holder; and a an electrically assembly including a first shield and a second shield assembled together to form a chamber for receiving the housing, the shielding assembly forming a pair of legs outwardly and extending to be substantially level with the bottom surface of each support arm for mounting to the circuit board.

2. The electrical connector as claimed in claim 1, wherein the bottom surface of the support arm is spaced a vertical distance from a bottom surface of the housing.

3. The electrical connector as claimed in claim 1, wherein the top wall of the housing rearwardly extends beyond the rear wall and defines a plurality of terminal receiving grooves for receiving the terminals of the terminal assembly.

4. The electrical connector as claimed in claim 1, further comprising a positioning post downwardly extending from each support arm of the housing for insertion into a corresponding hole defined in the circuit board.

5. The electrical connector as claimed in claim 1, further comprising a T-shaped support portion outwardly projecting from each side wall for supporting the insulative housing on the circuit board.

6. The electrical connector as claimed in claim 5, wherein a mounting opening is defined in the shielding assembly for engaging with the T-shaped support portion of the housing.

7. The electrical connector as claimed in claim 1, wherein the terminals of the terminal assembly each include a center portion, a contact portion reversely bent from the center portion, a mounting portion mounted in the terminal holder, and a tail portion extending rearwardly beyond the terminal holder.

8. The electrical connector as claimed in claim 1, wherein the support arm of the housing defines a recess for engaging with a portion of a side of the terminal holder of the terminal assembly, the holder defines a mounting recess in a side thereof, and the support arm of the housing forms a projection for engaging with the recess of the holder thereby securing the terminal assembly to the housing.

9. The electrical connector as claimed in claim 1, wherein the terminal are insert molded to the holder.

10. The electrical connector as claimed in claim 1, wherein a rear opening is defined in the rear wall of the housing for allowing the terminals to extend therethrough into the inner space of the housing.

11. The electrical connector as claimed in claim 1, wherein a support portion projects from a side wall of the housing and the first shield defines a side opening in a side shielding wall thereof for engaging with the support portion of the housing.

12. The electrical connector as claimed in claim 1, wherein the leg of the shielding assembly includes a horizontal portion resting on an edge of the circuit board and a perpendicular grounding portion inserted into a hole defined in the circuit board for securing the electrical connector to the circuit board.

13. The electrical connector as claimed in claim 1, wherein the leg of the shielding assembly comprises a solder pad adapted to be soldered to the circuit board.

14. The electrical connector as claimed in claim 1, wherein a lance is outwardly stamped from the second shield for engaging with an aperture defined in the first shield for assembling the first and second shields together.

15. The electrical connector as claimed in claim 1, wherein a lance is outwardly stamped from the first shield for engaging with an aperture defined in the second shield for assembling the first and second shields together.

16. The electrical connector as claimed in claim 1, wherein one of the shields defines a through opening corresponding to the front opening of the housing for extension of the mating plug therethrough.

17. The electrical connector as claimed in claim 16, wherein a resilient strip inwardly extends from an edge of the through opening for grounding the inserted mating plug.

18. An electrical connector mounted in a cutout defined in a circuit board, comprising:

an insulative housing including a top face, a bottom face, a front face, a rear face and two side faces commonly defining an inner space therein for receiving a mating plug;

a plurality of terminals positioned within the housing; and a shielding assembly including a first shield and a second shield fastened to the housing and to each other; wherein said first shield covers the top face, an upper portion of the rear face and upper portions of the two side faces which are all positioned above the circuit board, and the second shield covers the bottom face, a lower portion of the rear face and lower portions of the two side faces which are all positioned under the circuit board.

* * * * *